US008469217B2

(12) United States Patent
Gingras

(10) Patent No.: US 8,469,217 B2
(45) Date of Patent: Jun. 25, 2013

(54) VENTED CONTAINER

(75) Inventor: Ryan Paul Gingras, Charlotte, MI (US)

(73) Assignee: Dart Container Corporation, Mason, MI (US)

( * ) Notice: Subject to any disclaimer, the term of this patent is extended or adjusted under 35 U.S.C. 154(b) by 0 days.

(21) Appl. No.: 13/270,397

(22) Filed: Oct. 11, 2011

(65) Prior Publication Data

US 2012/0091136 A1 Apr. 19, 2012

Related U.S. Application Data

(60) Provisional application No. 61/392,799, filed on Oct. 13, 2010.

(51) Int. Cl.
*B65D 51/16* (2006.01)
*B65D 21/032* (2006.01)

(52) U.S. Cl.
USPC ..... 220/231; 220/4.21; 220/367.1; 206/509

(58) Field of Classification Search
USPC ..... 220/231, 4.23, 4.22, 4.21, 810, 367.1, 220/836, 781, 380; 206/508; 426/106
IPC ..... B65D 51/16,6/28, 8/18
See application file for complete search history.

(56) References Cited

U.S. PATENT DOCUMENTS

| | | | | |
|---|---|---|---|---|
| 3,557,995 | A * | 1/1971 | Mirasol et al. | 220/287 |
| 3,786,982 | A * | 1/1974 | Rakes et al. | 229/406 |
| 3,955,710 | A | 5/1976 | Commisso | |
| 4,687,117 | A | 8/1987 | Terauds | |
| 5,046,659 | A * | 9/1991 | Warburton | 220/4.22 |
| 5,269,430 | A * | 12/1993 | Schlaupitz et al. | 220/4.23 |
| 5,366,104 | A * | 11/1994 | Armstrong | 220/832 |
| 5,806,699 | A | 9/1998 | Ekkert et al. | |
| 5,897,011 | A * | 4/1999 | Brilliant et al. | 220/4.23 |
| 5,938,068 | A * | 8/1999 | Atkins et al. | 220/839 |
| 7,287,660 | B2 | 10/2007 | Ramirez et al. | |
| 7,487,880 | B2 | 2/2009 | Guarrascio | |
| 2003/0136699 | A1 * | 7/2003 | McNeeley et al. | 206/518 |
| 2005/0000966 | A1 | 1/2005 | Nordland et al. | |
| 2006/0000842 | A1 * | 1/2006 | Maxwell | 220/780 |
| 2008/0197134 | A1 | 8/2008 | Maxwell | |
| 2009/0218356 | A1 | 9/2009 | Colacitti | |

FOREIGN PATENT DOCUMENTS

| | | | |
|---|---|---|---|
| CA | 2216470 | A1 | 3/1999 |
| DE | 29915117 | U1 | 12/1999 |
| GB | 1441819 | A | 7/1976 |
| JP | 2009298449 | A | 12/2009 |
| WO | WO 8102108 | A1 * | 8/1981 |

* cited by examiner

*Primary Examiner* — Robert J Hicks
(74) *Attorney, Agent, or Firm* — McGarry Bair PC

(57) ABSTRACT

A thermoformed container comprising a tray having a bottom wall with a recess for storing food items, an open top for providing access to the recess and a cover sized to close the open top of the tray. The cover is hingedly connected to the tray, with both the cover and tray having cooperating structures that form a closure when the container is closed, with a vent structure provided in the container for venting the interior of the container.

20 Claims, 6 Drawing Sheets

VENTED CONTAINER

CROSS REFERENCE TO RELATED APPLICATIONS

The present application claims the benefit of U.S. Provisional Patent Application No. 61/392,799, filed Oct. 13, 2010, which is incorporated herein by reference in its entirety.

BACKGROUND OF THE INVENTION

Containers are commonly used in the food industry for transporting food home by a consumer, especially in the ready-to-eat food industry and in the restaurant industry for packaging leftovers. Hinged or clamshell food containers are very convenient in that they comprise a cover that is hingedly mounted to a tray, which provides for convenient storage by the food service provider and convenient operation by the user.

Clam shell containers are generally thermoformed from either expanded thermoplastics (foamed plastics), such as expanded polystyrene, or non-expanded thermoplastics (sheet plastics), sheet plastics, such as polypropylene (PP), oriented polystyrene (OPS) or polyethylene terephthalate (PET). Containers made from the foamed plastics have better insulating properties compared to the sheet plastics. Containers made from sheet plastics may have sharper corners, greater strength and more tear resistance compared to foamed plastics. The foam containers are best suited for applications where the insulating characteristics of the foam are of a high priority, such as when the food is to be maintained at temperature prior to serving. The non-expanded thermoplastic containers are best suited when forming an interlocking seal, as compared to an abutting seal, between the cover and the tray to prevent leakage is a high priority, such as when leftovers are being taken home from a restaurant. The non-expanded materials are much more suitable than the expanded materials for being easily formed into the cooperating complex shapes necessary for the cover and the tray to form a leak-proof seal when closed.

The use of interlocking seals, while beneficial to prevent leakage, are sufficiently air-tight that, for hot foods, there is a need to provide a vent to provide for the escape of air heated by the hot foods.

SUMMARY OF THE INVENTION

The invention relates to a thermoformed container for storing food items comprising a tray having a bottom wall from which extends a peripheral wall to define a recess for storing food items, and an open top for providing access to the recess, a cover sized to close the open top of the tray and comprising a top wall, a first closure structure provided on the tray, a second closure structure provided on the cover and complementary with the first closure structure such that the first and second closure structures cooperate to form an interlocking closure between the tray and the cover in a closed condition, and a recloseable vent provided in the cover comprising an invertible three-dimensional structure that may be inverted between closed and opened conditions to selectively form a vent opening.

The invention also relates to a thermoformed container for storing food items comprising a tray having a bottom wall from which extends a peripheral wall to define a recess for storing food items, and an open top for providing access to the recess, a cover sized to close the open top of the tray and comprising a top wall, a first closure structure provided on the tray, a second closure structure provided on the cover and complementary with the first closure structure such that the first and second closure structures cooperate to form an interlocking closure between the tray and the cover in a closed condition, and a recloseable vent assembly provided in the cover and comprising a vent opening and an invertible three-dimensional structure, which selectively opens/closes the vent opening upon inversion, wherein the vent opening and three-dimensional structure are oriented relative to each other such that the direction of inversion of the three-dimension structure is not aligned with the vent opening to minimize the likelihood a user's finger applying an inversion force will pass into the vent opening.

DESCRIPTION OF THE PREFERRED EMBODIMENT

Figure 1:
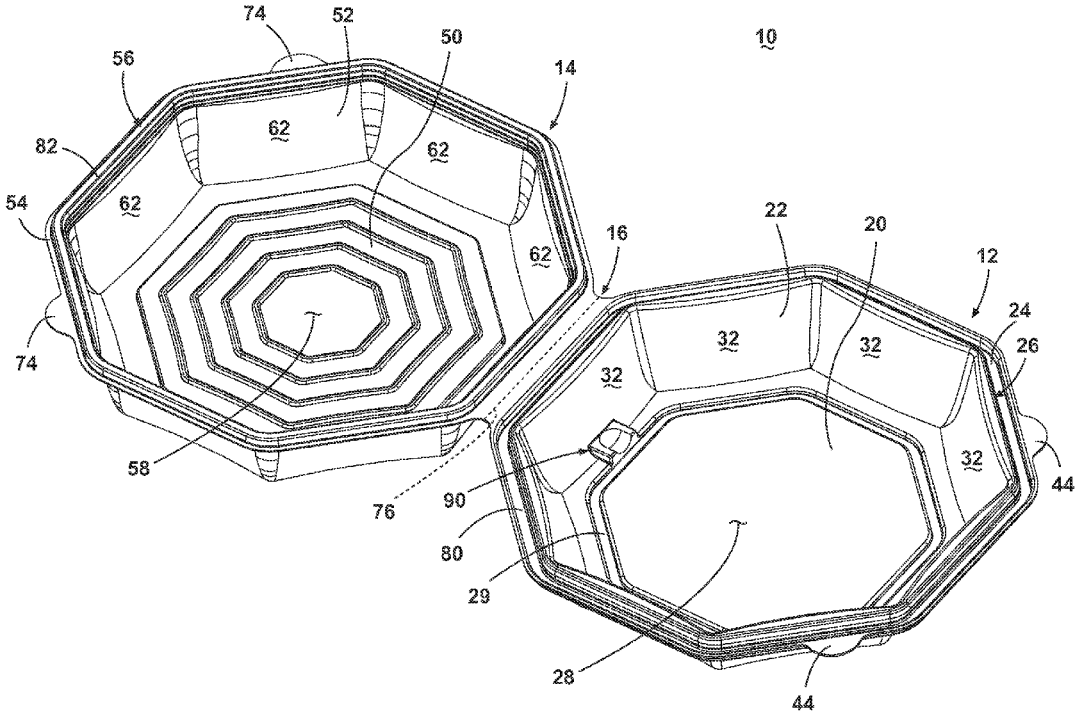
FIG. 1 is a perspective view of a clamshell container according to the invention comprising a cover hingedly mounted to a tray, with the cover in an open position, and having a vent assembly.

FIG. 1 illustrates a clamshell container 10 comprising a cover 12 and a tray 14, which are connected by a hinge 16. The clamshell container 10 is operable between an open condition (FIG. 1) and a closed condition (FIG. 2) by rotating the cover 12 about the hinge 16 from an open position to a closed position. The cover 12, tray 14, and hinge 16 are preferably integrally formed from a single piece of material in a well known thermoforming process. Suitable materials for the clamshell container 10 include OPS, PET, and PP.

The cover 12 comprises a top 20 from which extends a peripheral sidewall 22, which terminates in a peripheral flange 24 and from which extends a cover seal structure 26. A cover recess 28 is defined by the top 20 and the peripheral sidewall 22. A stacking ridge 29 is provided in the top 20.

The peripheral sidewall 22 is illustrated as having a generally vertical portion that transitions to a horizontal portion at the junction with the top 20. As illustrated, the peripheral sidewall 22 defines an octagonal shape defined by multiple faces or sides 32. However, the peripheral sidewall 22 may have fewer or more sides to define any desired shape, including ovals and circles. Spaced pull tabs 44 extend from the peripheral flange 24 and may be used to aid in opening the container 10.

The tray 14 has the same general configuration as the cover 12. That is, the tray 14 comprises a bottom 50 from which extends a peripheral sidewall 52, which terminates in a peripheral flange 54 and from which extends a tray seal structure 56. A tray recess 58 is defined by the bottom 50 and the peripheral sidewall 52.

The peripheral sidewall 52 is illustrated as having a generally vertical portion that transitions to a horizontal portion at the junction with the bottom 50. As illustrated, the peripheral sidewall 52 defines an octagonal shape defined by multiple faces or sides 62.

Spaced pull tabs 74 extend from the peripheral flange 54. The pull tabs 74 are complementary with corresponding pull tabs 44 to provide for the user to open the container 10 by separately pulling on opposing pull tabs 44, 74.

The hinge 16 is formed in the material connecting the peripheral flanges 24, 54. A line of weakness 76 may be formed in the material to define the rotational axis for the hinge. The line of weakness may be a score line, a perforated line, any combination of these, as well as other suitable structures.

The cover and tray seal structures 26, 56 have cooperating physical configurations that interlock to form a peripheral seal between the cover and tray that circumscribes the tray recess 58. As illustrated, the cover sealing structure 26 comprises a peripheral recess 80 and the tray sealing structure 56 comprises a peripheral rib 82, which is received within the peripheral recess 80 to form the peripheral seal. The cover and tray seal structures 26, 56 can be considered a closure in that they aid in maintaining the cover 12 and the tray 14 in the closed condition. In addition, the cover and tray seal structures 26, 56 can also aid in limiting the leakage of liquid from within the container 10. The interlocking of the cover and tray seal structures 26, 56 limits leakage of liquid from within the container 10 by creating a convoluted pathway through which liquid must flow to escape from within the container 10. In this sense, the seal structures 26, 56 form a seal.

Figure 2:
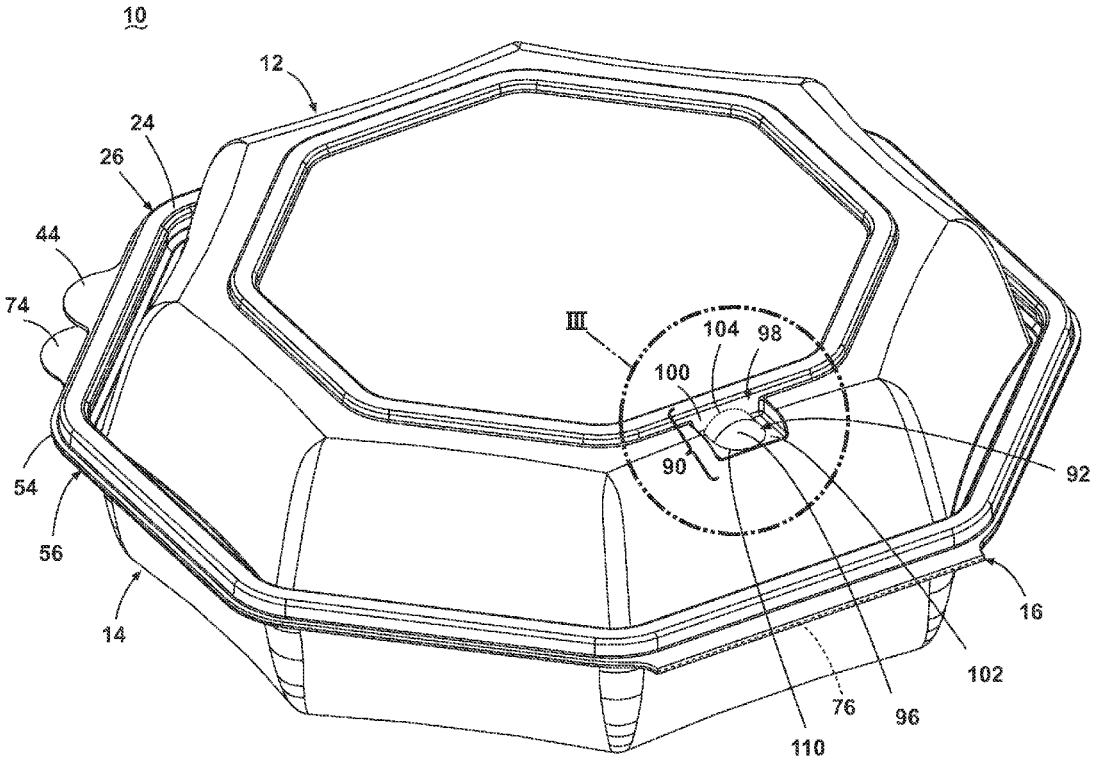
FIG. 2 is a perspective view of the clamshell container of FIG. 1 with the cover in a closed position.

Referring to FIG. 2, a vent assembly 90 is provided in the cover 12 and provides the container 10 with a selectively openable/closeable vent for the interior of the container 10 when the container 10 is closed. The vent assembly 90 comprises a closure element 92 that selectively closes a vent opening 94 (FIGS. 5 and 6).

Figure 3:
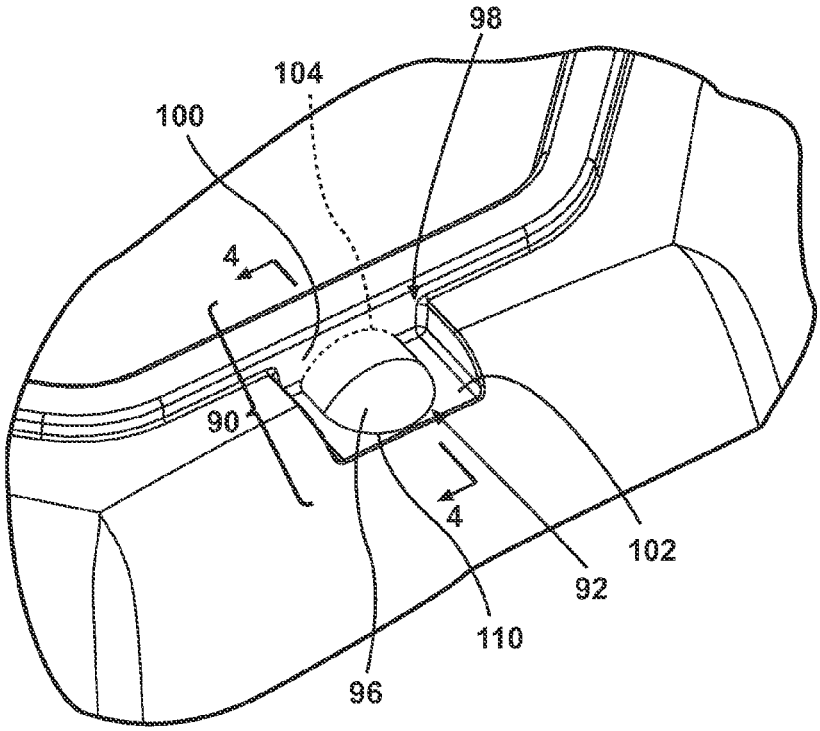
FIG. 3 is a perspective view of the vent assembly in a closed condition.

Referring to FIG. 3, as illustrated, the closure element 92 is a deformable, three-dimensional structure in the form of an invertible bubble 96 that may be selectively inverted to either open or close the vent opening 94. The vent assembly 90 is located within a recess 98 defined by a vertical wall 100, in which the vent opening 94 is formed, and a horizontal wall 102, in which the bubble 96 is formed. A line of weakness 104, such as a cut line or a perforation, is formed at the interface of the bubble 96 and the vent opening 94, with the interface forming an edge 106 for the vent opening 94 and a rear edge 108 for the bubble 96 (FIGS. 5 and 6). An inversion or hinge line 110, about which the bubble 96 inverts, is formed at the interface of the bubble 96 and the horizontal wall 102.

Figure 4:
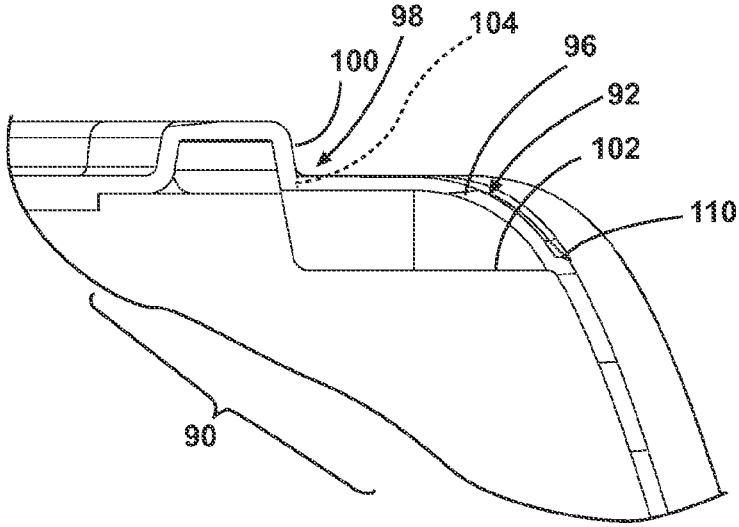
FIG. 4 is a sectional view taken along line 4-4 of FIG. 3.
Figure 5:
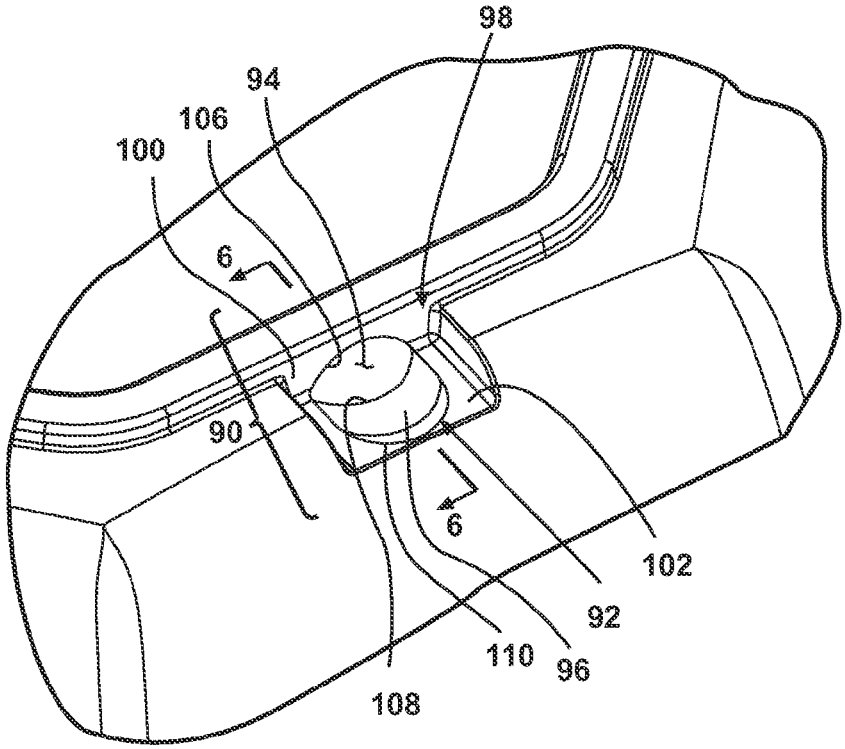
FIG. 5 is a perspective view of the vent assembly in an opened condition.
Figure 6:
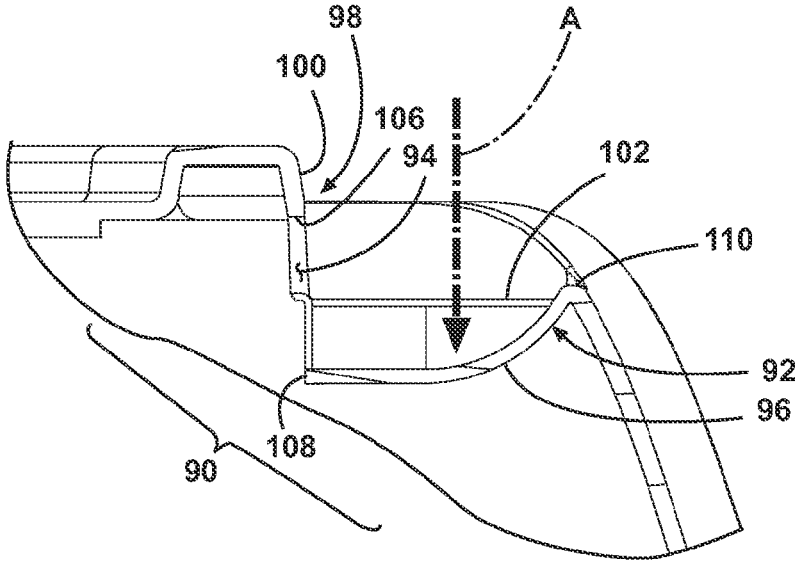
FIG. 6 is a sectional view taken along line 6-6 of FIG. 5.

The operation of the vent assembly 90 is best seen with reference to FIGS. 3-6, with FIGS. 3 and 4 illustrating the vent assembly 90 in a closed condition and FIGS. 5 and 6 illustrating the vent assembly 90 in the opened condition. Beginning with the vent assembly 90 in the closed condition, as illustrated in FIGS. 3 and 4, the bubble 96 is in a first inverted position and closes or blocks the vent opening 94.

To place the vent assembly 90 in the opened condition as illustrated in FIGS. 5 and 6, the bubble 96 is inverted to a second inverted position where the rear edge 108 of the bubble 96 is spaced from the edge 106 of the vent opening 94, which, in addition to opening the vent opening 94, also increases the size of the vent opening 94. During the transition between the inverted positions, the material forming the bubble 96 inverts about hinge line 110.

To move the bubble 96 between the two inverted positions, a user merely presses on the bubble 96 with a finger tip to apply a force sufficient to invert the bubble 96. If the bubble 96 is being inverted for the first time, the force applied by the user's finger will need to be great enough to rupture the line of weakness 104.

It is notable that the bubble 96 and vent opening 94 are configured such that the direction of the inverting force (arrow A in FIG. 6) applied by the finger is not into vent opening 94. This makes it much less likely that during the opening of the vent assembly 90, the user will accidentally insert a finger through the vent opening 94 and possibly into the food within the container 10. The shape of the bubble 96, with its U-shaped cross section, also tends to cup and hold the finger during insertion, which further reduces the likelihood that the user's finger will enter the vent opening 94.

The three-dimensional structure of the bubble 96 also provides the bubble 96 with a structure having an inherent rigidity that retains the bubble in either of the inverted positions until a user applied force overcomes the inherent rigidity. As illustrated, the U-shaped cross section provides the bubble 96 with an archway-like structure that provides inherent rigidity.

The resilient nature of the non-expanded thermoplastic material from which the bubble 96 is made provides for repeated inversions of the bubble 96 without failure, which for practical purposes will outlast the usefulness of the container. Thus, the bubble 96 may be inverted as many times as desired.

Figure 7:
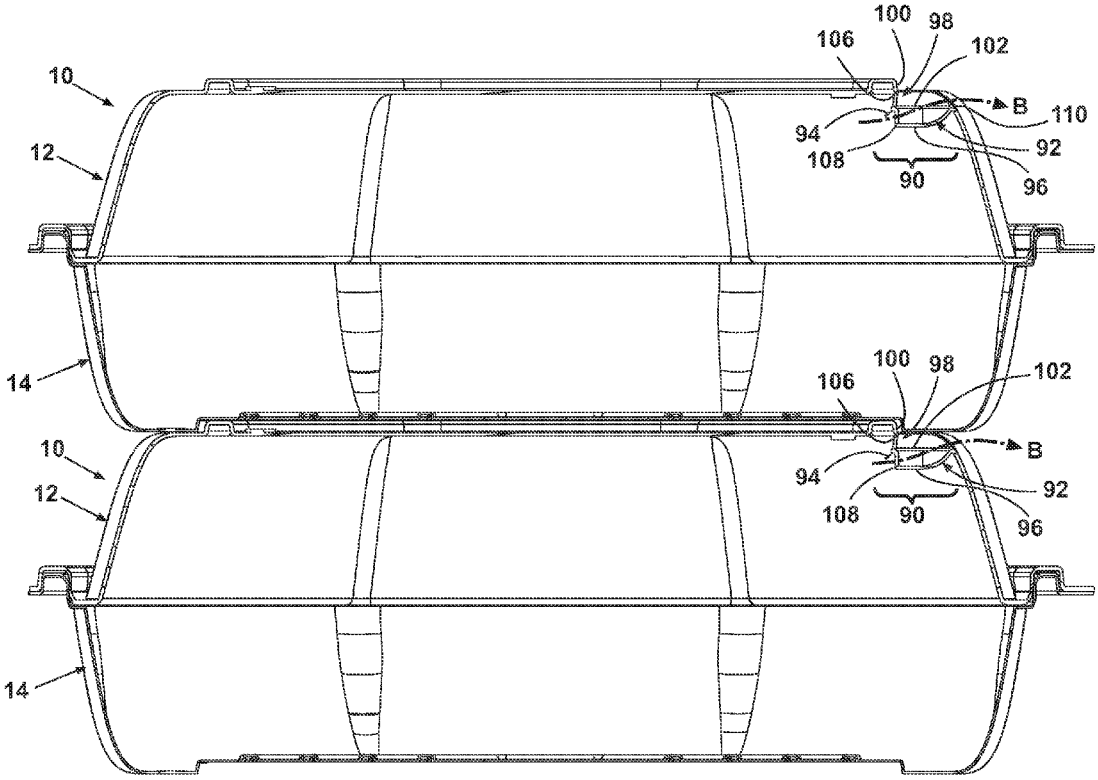
FIG. 7 is a sectional view of two of the containers in a stacked configuration.

While a line of weakness 104 is described as initially connecting the bubble 96 to the edge 106 of the vent opening 94, it is possible for the interface between the bubble 96 and vent opening 94 to be completely cut through. When no venting is desired, the amount of open area provided by a complete cut-through would not be functionally detrimental. A similar result is achieved if the line of weakness is a perforated line with each opening of the perforation being formed from small flaps which are not completely removed. The flaps tend to resiliently return toward the corresponding opening, which retards air flow through the openings. Thus, any venting provided by the perforations is inconsequential to that provided by the vent opening 94. FIG. 7 illustrates two of the containers 10 in a stacked configuration, with the vent assemblies 90 in the opened condition. When in the stacked configuration, there remains an air flow path (arrow B) between the containers 10 such that air may flow through the vent assemblies 90 without being blocked by another container. Location of the vent assembly 90 in the recess 98 and the stacking ridge 29 can facilitate airflow through the vent between two stack containers 10. However, it is also within the scope of the invention for the vent assembly 90 to be used without the recess 98 and/or stacking ridge 29.

Figure 8:
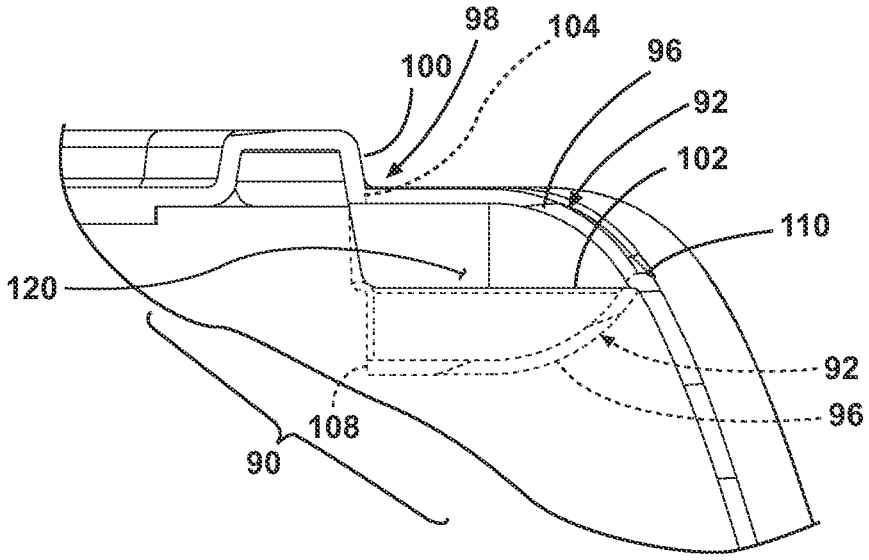
FIG. 8 is a sectional view of the vent assembly illustrating both the closed and opened conditions.

FIG. 8 illustrates the vent assembly 90 in both the closed (solid) and opened (dotted) conditions. The three-dimensional structure of the bubble 96 partially defines a volume 120, through which the bubble 96 passes as the bubble 96 is inverted between the closed (solid) and opened (dotted) conditions.

The container described herein is a thin-walled container formed through a thermoforming process. Disposable containers are typically fabricated from thermoforming instead of injection molding due to lower fabrication costs and higher production rates. Injection molded containers generally use a much greater amount of material and have a greater thickness than thermoformed containers, adding additional, unnecessary cost, especially in the case of a disposable container.

In an injection molding process, an injection mold defines a three-dimensional cavity that is filled with molten plastic to form the parts of the container. In contrast, the thermoforming process uses an effectively two-dimensional sheet of material that is pressed around a form. The injection molding process can form pieces having varying thickness, whereas the thermoforming process can only make parts having a thickness equal to, or due to stretching, less than the thickness of the sheet material. The thermoforming process uses a web of plastic that is heated to or beyond its glass state, which permits the web to be shaped, but does not require as long of a cooling time as other processes, such as injection molding process, for example. In this manner, the thermoformed web is shaped and advanced to the next production step much faster than with the injection molding process.

While the invention has been specifically described in connection with certain specific embodiments thereof, it is to be understood that this is by way of illustration and not of limitation. Reasonable variation and modifications are possible within the scope of the foregoing disclosure and drawings without departing from the spirit of the invention which is defined in the appended claims.

What is claimed is:

1. A thermoformed container for storing food items, comprising:

a tray comprising a bottom wall from which extends a peripheral wall to define a recess for storing food items, and an open top for providing access to the recess;

a cover sized to close the open top of the tray and comprising a top wall;

a first closure structure provided on the tray;

a second closure structure provided on the cover and complementary with the first closure structure such that the first and second closure structures cooperate to form an interlocking closure with a peripheral seal between the tray and the cover in a closed condition; and a reclosable vent provided in the cover comprising an invertible three-dimensional structure that may be inverted between closed and opened conditions to selectively form a vent opening while the cover remains sealed with the tray in the closed condition.

2. The thermoformed container of claim 1 further comprising a hinge connecting the tray and the cover for relative movement between an opened and a closed condition such that the tray and cover can be relatively moved to selectively close the tray with the cover.

3. The thermoformed container of claim 2 wherein the hinge comprises a line of weakness to define a rotational axis for the hinge.

4. The thermoformed container of claim 3 wherein the line of weakness is configured to facilitate separation of the cover from the tray along the line of weakness.

5. The thermoformed container of claim 1 wherein the three-dimensional structure partially defines a volume in the closed and opened conditions and the three-dimensional structure moves through the partially defined volume when it is inverted between the closed and opened conditions.

6. The thermoformed container of claim 1 wherein the three-dimensional structure is formed in a portion of the cover forming a first plane and the three-dimensional structure projects away from the first plane when the three-dimensional structure is in the closed and opened conditions.

7. The thermoformed container of claim 1 wherein the cover further includes a recess defined by a vertical wall and a horizontal wall and the vent opening is formed in the vertical wall and the three-dimensional structure is formed in the horizontal wall.

8. The thermoformed container of claim 1 wherein an interface between the three-dimensional structure and the vent opening comprises a line of weakness and wherein the three-dimensional structure is separated from the vent opening along the line of weakness when the three-dimensional structure is inverted between the closed and opened positions.

9. The thermoformed container of claim 1 further comprising a first stacking structure formed in the top wall of the cover and a second stacking structure formed in the bottom wall and configured to mate with the first stacking structure such that two of the thermoformed containers may be vertically stacked upon the mating of the first and second stacking structure, and the vent opening is located relative to the first and second stacking structures such that the vent opening is not closed off when two of the thermoformed containers are vertically stacked.

10. The thermoformed container of claim 1 wherein the cover and the tray comprise a thin-walled plastic formed by thermoforming a single sheet of plastic.

11. The thermoformed container of claim 1 wherein the three-dimensional structure comprises a bubble having a U-shaped cross-section.

12. The thermoformed container of claim 1 wherein the three-dimensional structure is configured such that an inverting force applied by a user to invert the three-dimensional structure between the closed and opened conditions is not directed towards the vent opening.

13. A thermoformed container for storing food items, comprising:

a tray comprising a bottom wall from which extends a peripheral wall to define a recess for storing food items, and an open top for providing access to the recess;

a cover sized to close the open top of the tray and comprising a top wall;

a first closure structure provided on the tray;

a second closure structure provided on the cover and complementary with the first closure structure such that the first and second closure structures cooperate to form an interlocking closure with a peripheral seal between the tray and the cover in a closed condition;

a reclosable vent assembly provided in the cover and comprising a vent opening and an invertible three-dimensional structure, which selectively opens and closes the vent opening upon inversion while the cover remains sealed with the tray in the closed condition;

wherein the vent opening and three-dimensional structure are oriented relative to each other such that a direction of inversion of the three-dimensional structure is not aligned with the vent opening to minimize the likelihood a user's finger applying an inversion force will pass into the vent opening.

14. The thermoformed container of claim 13 further comprising a hinge connecting the tray and the cover for relative movement between an opened and a closed condition such that the tray and cover can be relatively moved to selectively close the tray with the cover.

15. The thermoformed container of claim 13 wherein the three-dimensional structure partially defines a volume when the vent opening is opened and closed and wherein the three-dimensional structure moves through the partially defined volume when the vent opening is opened and closed.

16. The thermoformed container of claim 13 wherein the three-dimensional structure is formed in a portion of the cover forming a first plane and the three-dimensional structure projects away from the first plane when the vent opening is opened and closed.

17. The thermoformed container of claim 13 wherein the cover further includes a recess defined by a vertical wall and a horizontal wall and the vent opening is formed in the vertical wall and the three-dimensional structure is formed in the horizontal wall.

18. The thermoformed container of claim 13 wherein an interface between the three-dimensional structure and the vent opening comprises a line of weakness and the three-dimensional structure is separated from the vent opening along the line of weakness when the three-dimensional structure is inverted to selectively open the vent opening.

19. The thermoformed container of claim 13 wherein the cover and the tray comprise a thin-walled plastic formed by thermoforming a single sheet of plastic.

20. The thermoformed container of claim 13 further comprising a first stacking structure formed in the top wall of the cover and a second stacking structure formed in the bottom wall and configured to mate with the first stacking structure such that two of the thermoformed containers may be vertically stacked upon the mating of the first and second stacking structure, and the vent opening is located relative to the first and second stacking structures such that the vent opening is not closed off when two of the thermoformed containers are vertically stacked.

* * * * *